United States Patent [19]

Berecz

[11] Patent Number: 4,586,405

[45] Date of Patent: May 6, 1986

[54] NUT DRIVER

[76] Inventor: Imre Berecz, 26562 Shane Dr., El Toro, Calif. 92630

[21] Appl. No.: 756,501

[22] Filed: Jul. 19, 1985

[51] Int. Cl.[4] ..... B25B 23/02

[52] U.S. Cl. ..... 81/57.37; 81/433

[58] Field of Search ..... 81/57.37, 433; 29/813

[56] References Cited

U.S. PATENT DOCUMENTS

| | | | |
|---|---|---|---|
| 2,219,484 | 10/1940 | Lyon | 81/433 |
| 2,878,700 | 3/1959 | Reynolds | 81/57.37 |
| 3,526,257 | 9/1970 | Kirkland | 81/433 |
| 3,656,520 | 4/1972 | Caffa | 81/57.37 |
| 3,907,014 | 9/1975 | Manino | 81/57.37 |

*Primary Examiner*—James L. Jones, Jr.
*Attorney, Agent, or Firm*—Lyman R. Lyon

[57] ABSTRACT

A nut driver comprising a generally cylindrical frame having a cylindrical nut magazine disposed thereabout comprising a pair of semi-cylindrical magazine sections each having a plurality of elongated, aligned circumferentially spaced fastener chambers therein, a front magazine holder on said frame having an annular channel for the acceptance of one end portion of said magazine, and a rear magazine holder having an annular channel for the acceptance of an opposite end portion of said magazine.

2 Claims, 4 Drawing Figures

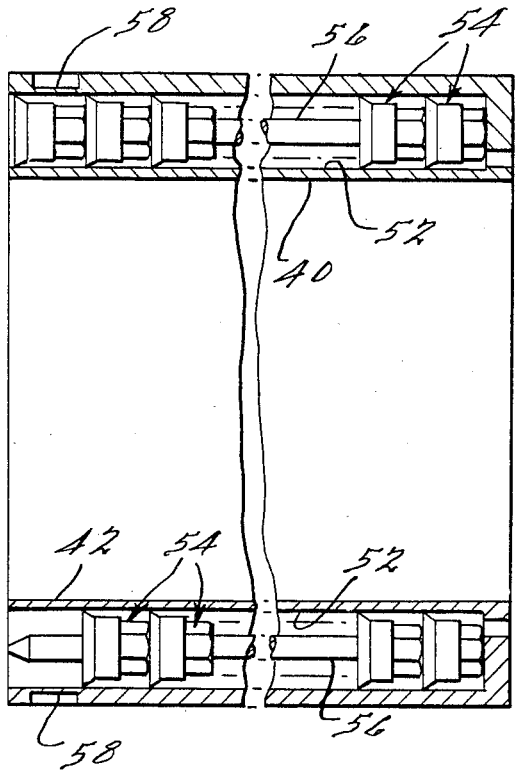
FIG. 3.
FIG. 4.
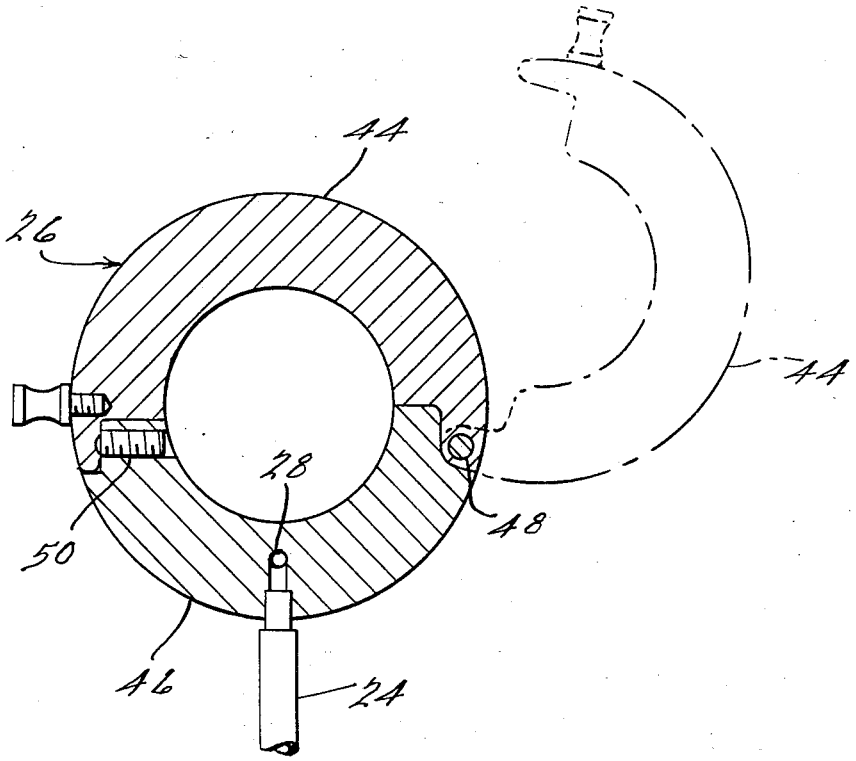

NUT DRIVER

BACKGROUND OF THE INVENTION

Portable power driven nut drivers of the type disclosed in U.S. Pat. No. 3,750,257 deliver individual female fasteners to a work station and sequentially rotate the fasteners onto a bolt. However, a need exists for such a tool that is extremely compact yet is capable of carrying a large supply of female threaded fasteners so as to minimize work stoppage incident to reloading.

SUMMARY OF THE INVENTION

A nut driver in accordance with the instant invention comprises a frame of pistol-like configuration for mounting of a conventional air motor, a fastener driving mechanism, and a fastener shuttle mechanism which moves fasteners from a magazine delivery station to a driving station. The nut driver is provided with a cylindrical magazine which contains a plurality of supply tubes each of which carries a plurality of threaded fasteners. The fasteners are supplied to a delivery station, transferred to a driving station, and thereafter threaded onto complementary bolts. The nut driver of the present invention is light and extremely compact due to the orientation of the magazine around the frame.

BRIEF DESCRIPTION OF THE DRAWINGS

FIG. 3 is a longitudinal section of the cylindrical supply magazine taken along the line 3—3 of FIG. 2 with nuts mounted on the magazine spindles; and FIG. 4 is a sectional view of the rear magazine holder taken along the line 4—4 of FIG. 1.

DETAILED DESCRIPTION OF THE PREFERRED EMBODIMENT OF THE INVENTION

Figure 1:
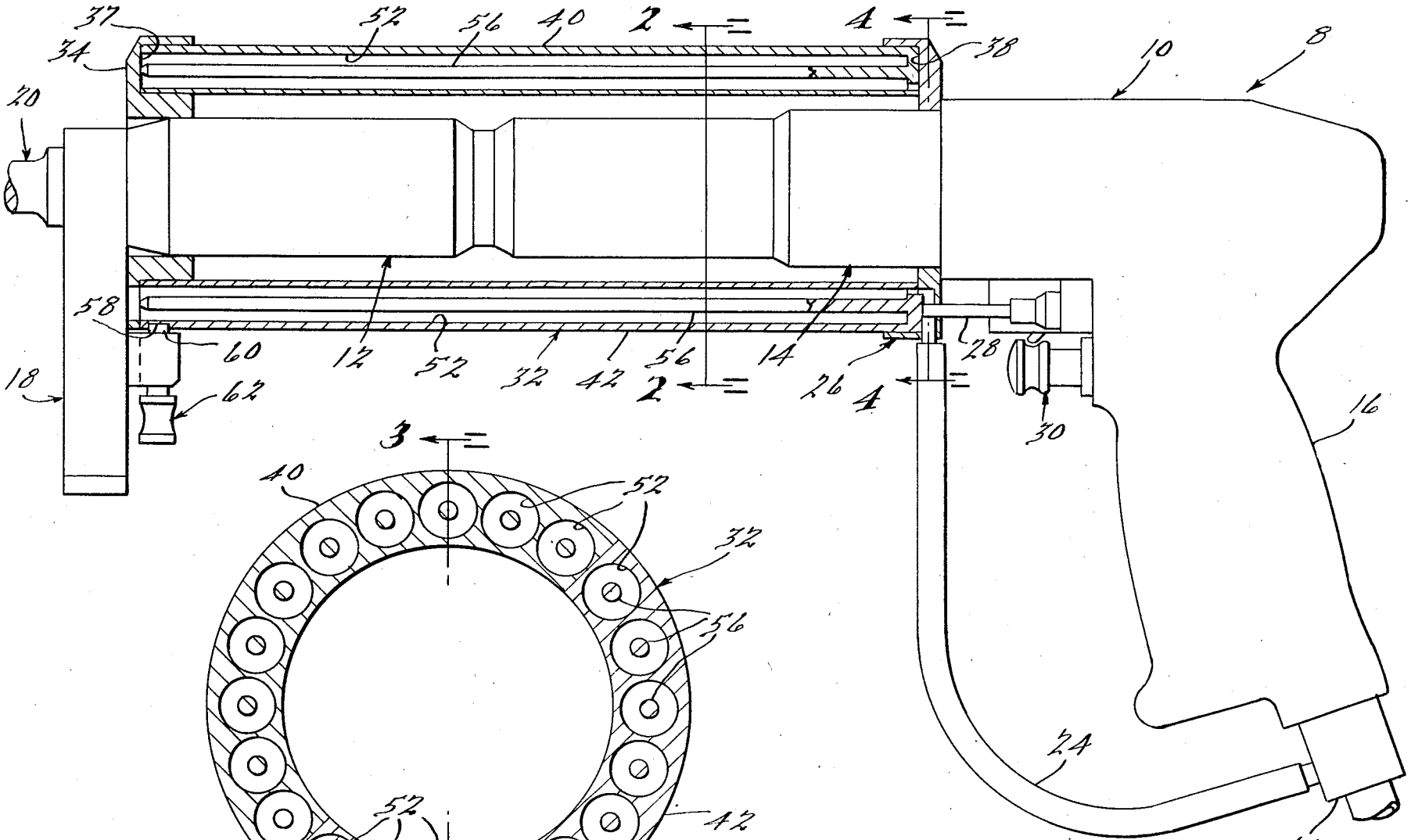
FIG. 1 is a side elevational view partially in section, of a nut driver of the present invention.

As best seen in FIG. 1 of the drawings, a portable semiautomatic nut driver 8 comprises a housing 10, for the support of a nut driving mechanism 12 and pneumatic motor 14. The housing 10 has a pistol grip 16 to facilitate manual handling and operation. A transfer mechanism 18 delivers nuts to a nosepiece 20. The aforesaid components are disclosed in said U.S. Pat. No. 3,750,257, and the construction thereof is incorporated herein by reference.

Air is supplied from a conventional source (not shown) to a T connector 22 for energization of the motor 14 through lines internal of the handle 16. An external air line 24 extends from the T connector 22 to a rear magazine support 26 for energizing the transfer mechanism 18 and for moving nuts to the transfer mechanism 18. Flow of air from the line 24 to the magazine holder 26 is controlled by a needle valve 28 which is actuated by a manually operable trigger 30.

In accordance with the instant invention, a cylindrical supply magazine 32 encircles the clutch mechanism 12 and motor 14 of the nut driver 8. The magazine 32 is retained in position by a front holder 34 and the rear holder 26. The holders 34 and 26 have annular channels 37 and 38 therein, respectively for the acceptance of the magazine 26.

Figure 2:
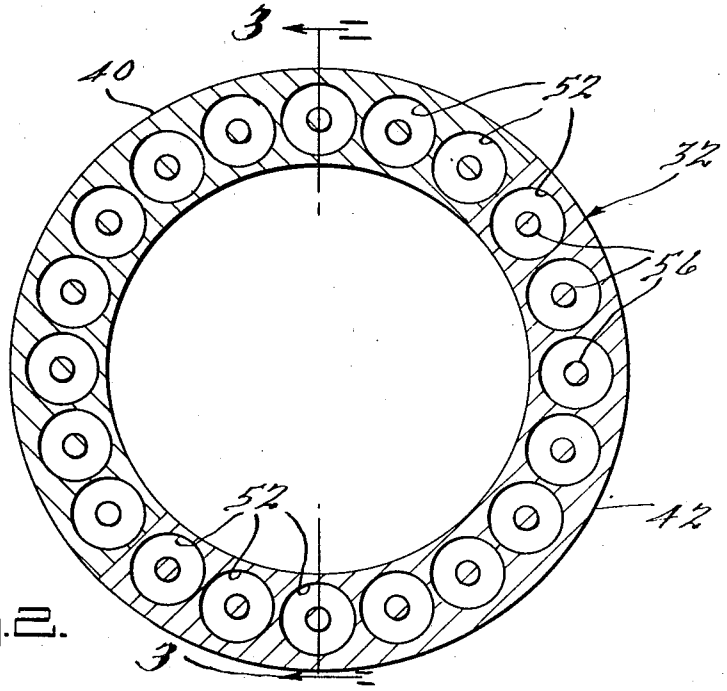
FIG. 2 is a sectional view taken substantially along the line 2—2 of FIG. 1.

As best seen in FIG. 2, the magazine 32 is split longitudinally into two sections 40 and 42 to facilitate loading into the rear and front magazine supports 26 and 34. As best seen in FIG. 4, the rear magazine support 26 is split into two sections 44 and 46 which are pinned to one another for relative rotation as by a pin 48. A spring loaded detent 50 maintains the section 44 of the rear retainer 26 in the closed position relative to the section 46 thereof.

Each magazine section 40 and 42 contains a plurality of aligned fastener chambers 52 for the acceptance of conventional fasteners 54 which are supported by centrally disposed spindles 56.

As best seen in FIG. 3, the magazine 32 is provided with a plurality of detents 58 for the acceptance of an end portion 60 of a magazine positioning pin 62 so as to index the magazine 32 relative to the transfer mechanism 18.

While the preferred embodiment of the invention has been disclosed, it should be appreciated that the invention is susceptible of modification without departing from the scope of the following claims.

I claim:

1. In a nut driver comprising a frame having a generally cylindrical portion with a motor and a nut driving mechanism disposed internally thereof, an improved cylindrical nut magazine coaxially related to the cylindrical portion of the frame of said nut driver, said magazine comprising, a pair of semi-cylindrical magazine sections each having a plurality of elongated, aligned circumferentially spaced fastener chambers therein, a front magazine holder on said frame having an annular channel for the acceptance of one end portion of said magazine, and a rear magazine holder on said frame having an annular channel for the acceptance of an opposite end portion of said magazine.

2. A nut driver in accordance with claim 1 wherein said rear magazine holder comprises a pair of semi-circular holder portions rotatable relative to one another about an axis extending parallel to a central axis of said motor to facilitate insertion of said magazine thereinto.

* * * * *